US009772585B2

(12) United States Patent
Shimojima et al.

(10) Patent No.: US 9,772,585 B2
(45) Date of Patent: Sep. 26, 2017

(54) COOLING CONVEYOR AND IMAGE FORMING APPARATUS INCORPORATING SAME

(71) Applicants: Kazuhiro Shimojima, Ibaraki (JP); Hiroaki Miyagawa, Ibaraki (JP)

(72) Inventors: Kazuhiro Shimojima, Ibaraki (JP); Hiroaki Miyagawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 36 days.

(21) Appl. No.: 14/638,660

(22) Filed: Mar. 4, 2015

(65) Prior Publication Data

US 2015/0253699 A1 Sep. 10, 2015

(30) Foreign Application Priority Data

Mar. 5, 2014 (JP) ..... 2014-042597
Mar. 5, 2014 (JP) ..... 2014-042598

(51) Int. Cl.
*G03G 15/20* (2006.01)
*G03G 21/20* (2006.01)

(52) U.S. Cl.
CPC ..... *G03G 15/2021* (2013.01); *G03G 15/2017* (2013.01); *G03G 15/2032* (2013.01); *G03G 15/2035* (2013.01); *G03G 15/2067* (2013.01); *G03G 15/2071* (2013.01); *G03G 21/206* (2013.01)

(58) Field of Classification Search
CPC ..... G03G 15/2021; G03G 15/2017; G03G 15/2032; G03G 15/2035; G03G 15/2067; G03G 15/2071; G03G 21/206; G03G 2215/0054; G03G 2215/00544
See application file for complete search history.

(56) References Cited

U.S. PATENT DOCUMENTS

2012/0315069 A1 12/2012 Ikeda et al.
2013/0170882 A1* 7/2013 Shimada ..... G03G 8/00 399/341
2014/0186080 A1 7/2014 Ikeda et al.
2014/0186081 A1 7/2014 Hirasawa et al.
2014/0212164 A1 7/2014 Miyagawa et al.
2014/0233996 A1 8/2014 Ikeda et al.
2014/0308057 A1* 10/2014 Tomino ..... G03G 15/2017 399/341
2014/0308058 A1 10/2014 Ikeda et al.
2014/0334858 A1 11/2014 Miyagawa et al.

FOREIGN PATENT DOCUMENTS

JP 2012-255964 12/2012

OTHER PUBLICATIONS

U.S. Appl. No. 14/321,908, filed Jul. 2, 2014.
U.S. Appl. No. 14/487,435, filed Sep. 16, 2014.
U.S. Appl. No. 14/477,129, filed Sep. 4, 2014.

* cited by examiner

*Primary Examiner* — Joseph S Wong
(74) *Attorney, Agent, or Firm* — Oblon, McClelland, Maier & Neustadt, L.L.P.

(57) ABSTRACT

A cooling conveyor includes a conveyor, a cooler, and a pipe. The conveyor includes at least a first conveyor and a second conveyor to sandwich and convey a recording material. The first conveyor approaches and separates from the second conveyor. The cooler is disposed in the second conveyor to cool the recording material after an image is fixed on the recording material. The pipe is connected to the cooler to flow a cooling liquid into the cooler.

17 Claims, 16 Drawing Sheets

COOLING CONVEYOR AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2014-042597, filed on Mar. 5, 2014, and 2014-042598 filed on Mar. 5, 2014, in the Japan Patent Office, the entire disclosure of each of which is hereby incorporated by reference herein.

BACKGROUND

Technical Field

Embodiments of the present disclosure relate to a cooling conveyor and an image forming apparatus incorporating the cooling conveyor.

Description of the Related Art

A cooling device is known to cool a recording material after toner is fixed on the recording material. For example, a cooling device circulates liquid-type refrigerant through a heat receiving part, contacts a recording material with the heat receiving part to take heat from the recording material. The recording material is sandwiched and conveyed with an upper belt and a lower belt that are arranged in a thickness direction of the recording material.

SUMMARY

In at least one embodiment of the present disclosure, there is provided a cooling conveyor including a conveyor, a cooler, and a pipe. The conveyor includes at least a first conveyor and a second conveyor to sandwich and convey a recording material. The first conveyor approaches and separates from the second conveyor. The cooler is disposed in the second conveyor to cool the recording material after an image is fixed on the recording material. The pipe is connected to the cooler to flow a cooling liquid into the cooler.

In at least one embodiment of the present disclosure, there is provided an image forming apparatus including the cooling conveyor and an image forming device to form the image on the recording material.

In at least one embodiment of the present disclosure, there is provided a cooling conveyor including a conveyor, a cooler, and a pipe. The conveyor includes at least a first conveyor and a second conveyor to sandwich and convey a recording material. The first conveyor and the second conveyor relatively approach and separate from each other. The cooler cools the recording material after an image is fixed on the recording material. The pipe is connected to the cooler to flow a cooling liquid into the cooler. The pipe includes a connecting portion connected to the cooler and a channel shift portion disposed away from a movement range of one of the first conveyor and the second conveyor and extending in a direction different from a direction in which the connecting portion is arranged.

In at least one embodiment of the present disclosure, there is provided a cooling conveyor including a conveyor, a cooler, and a pipe.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
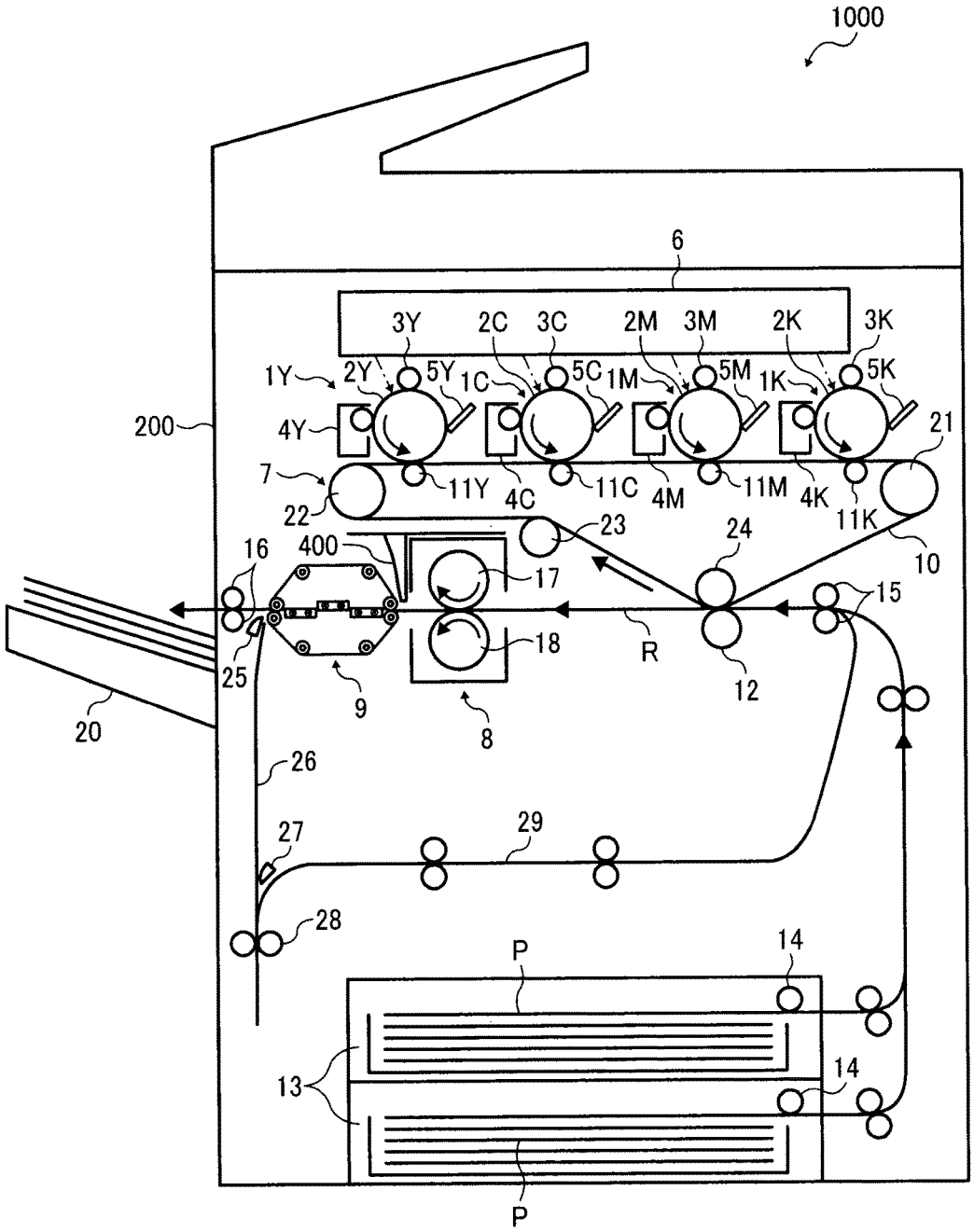
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

FIG. 1 is a schematic view of a configuration of a color image forming apparatus 1000 according to an embodiment of this disclosure. The image forming apparatus 1000 illustrated in FIG. 1 includes a tandem-type image forming section in which four process units 1Y, 1C, 1M, and 1Bk serving as image forming units are tamdemly arranged. The process units 1Y, 1C, 1M, and 1Bk are removably mountable relative to an apparatus body 200 of the image forming apparatus and have substantially the same configuration except for containing different color toners of yellow (Y), cyan (C), magenta (M), and black (Bk) corresponding to color separation components of a color image.

Specifically, each of the process units 1Y, 1C, 1M, and 1Bk includes, e.g., a photoconductor 2, a charging roller 3, a developing device 4, and a cleaning blade 5. The photoconductor 2 has, e.g., a drum shape and serves as a latent image carrier. The charging roller 3 serves as a charging device to charge a surface of the photoconductor 2. The developing device 4 forms a toner image on the surface of the photoconductor 2. The cleaning blade 5 serves as a cleaner to clean the surface of the photoconductor 2. In FIG. 1, the photoconductor 2, the charging roller 3, the developing device 4, and the cleaning blade 5 of the process unit 1Y for yellow are represented by the photoconductor 2Y, the charging roller 3Y, the developing device 4Y, and the cleaning blade 5Y, respectively. Regarding the other process units 1C, 1M, and 1Bk, color index are omitted for simplicity.

In FIG. 1, above the process units 1Y, 1C, 1M, and 1Bk, an exposing device 6 is disposed to expose the surface of the photoconductor 2. The exposing device 6 includes, e.g., a light source, polygon mirrors, f-lenses, and reflection lenses to irradiate a laser beam onto the surface of the photoconductor 2.

A transfer device 7 is disposed below the process units 1Y, 1C, 1M, and 1Bk. The transfer device 7 includes an intermediate transfer belt 10 formed of an endless belt serving as a transfer body. The intermediate transfer belt 10 is wound around a plurality of rollers 21 to 24 serving as support members. One of the rollers 21 to 24 is rotated as a driving roller to circulate the intermediate (rotate) transfer belt 10 in a direction indicated by arrow D in FIG. 1.

Four primary transfer rollers 11 serving as primary transfer devices are disposed at positions at which the primary transfer rollers 11 oppose the respective photoconductors 2. At the respective positions, the primary transfer rollers 11 are pressed against an inner circumferential surface of the intermediate transfer belt 10. Thus, primary transfer nips are formed at positions at which the photoconductors 2 contact pressed portions of the intermediate transfer belt 10. Each of the primary transfer rollers 11 is connected to a power source, and a predetermined direct current (DC) voltage and/or an alternating current (AC) voltage are supplied to the primary transfer rollers 11.

A secondary transfer roller 12 serving as a second transfer device is disposed at a position at which the secondary transfer roller 12 opposes the roller 24, which is one of the rollers around which the intermediate transfer belt 10 is wound. The secondary transfer roller 12 is pressed against an outer circumferential surface of the intermediate transfer belt 10. Thus, a secondary transfer nip is formed at a position at which the secondary transfer roller 12 and the intermediate transfer belt 10 contact each other. Like the primary transfer rollers 11, the secondary transfer rollers 12 is connected to a power source, and a predetermined direct current (DC) voltage and/or an alternating current (AC) voltage are supplied to the secondary transfer roller 12.

Below the apparatus body 200 is a plurality of feed trays 13 to store sheet-type recording materials P, such as a sheet of paper or overhead projector (OHP) sheet. Each feed tray 13 is provided with a feed roller 14 to feed the recording materials P stored. An output tray 20 is mounted on an outer surface of the apparatus body 200 at the left side in FIG. 1 to stack recording materials P discharged to an outside of the apparatus body 200.

The apparatus body 200 includes a transport path R to transport a recording material P from the feed trays 13 to the output tray 20 through the secondary transfer nip. On the transport path R, registration rollers 15 are disposed upstream from the secondary transfer roller 12 in a transport direction of a recording material (hereinafter, recording-material transport direction). A fixing device 8, a cooling device 9, and paired output rollers 16 are disposed in turn at positions downstream from the secondary transfer roller 12 in the recording-material transport direction. The fixing device 8 includes a fixing roller 17 and a pressing roller 18. The fixing roller serves as a fixing member including an internal heater. The pressing roller 18 serves as a pressing member to press the fixing roller 17. A fixing nip is formed at a position at which the fixing roller 17 and the pressing roller 18 contact each other.

Next, a typical operation of the image forming apparatus is described with reference to FIG. 1. When imaging operation is started, the photoconductor 2 of each of the process units 1Y, 1C, 1M, and 1Bk is rotated counterclockwise in FIG. 1, and the charging roller 3 uniformly charges the surface of the photoconductor 2 with a predetermined polarity. Based on image information of a document read by a reading device, the exposing device 6 irradiates laser light onto the charged surface of the photoconductor 2 to form an electrostatic latent image on the surface of the photoconductor 2. At this time, image information exposed to each photoconductor 2 is single-color image information obtained by separating a desired full-color image into single-color information on yellow, cyan, magenta, and black. Each developing device 4 supplies toner onto the electrostatic latent image formed on the photoconductor 2, thus making the electrostatic latent images a visible image as a toner image.

One of the rollers 21 to 24 around which the intermediate transfer belt 10 is wound is driven for rotation to circulate the intermediate transfer belt 10 in the direction D in FIG. 1. A voltage having a polarity opposite a charged polarity of toner and subjected to constant voltage or current control is supplied to each of the primary transfer rollers 11. As a result, a transfer electric field is formed at the primary transfer nip between each primary transfer roller 11 and the opposing photoconductor 2. Toner images of respective colors on the photoconductors 2 are transferred one on another onto the intermediate transfer belt 10 by the transfer electric fields formed at the primary transfer nips. Thus, the intermediate transfer belt 10 bears a full-color toner image on the surface of the intermediate transfer belt 10. Residual toner remaining on each photoconductor 2 without being transferred onto the intermediate transfer belt 10 is removed with the cleaning blade 5.

With rotation of the feed roller 14, a recording material P is fed from the corresponding feed tray 13. The recording material P is further sent to the secondary transfer nip between the secondary transfer roller 12 and the intermediate transfer belt 10 by the registration rollers 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip. By the transfer electric field formed at the secondary transfer nip, the toner image on the intermediate transfer belt 10 is collectively transferred onto the recording material P. Then, the recording material P is sent into the fixing device 8, and the fixing roller 17 and the pressing roller 18 apply heat and pressure to fix the toner image on the recording material P. After the recording material P is cooled with the cooling device 9, the paired output rollers 16 outputs the recording material P onto the output tray 20.

For duplex (double-side) printing, a switching pawl 25 is switched to guide the recording material P to a reverse recording-material transport passage 26 after cooling. Further, a switching pawl 27 is switched to rotate, e.g., feed rollers 28 in reverse. As a result, the reversed recording material P is fed from a reverse recording-material transport passage 29 to the registration rollers 15 again, and thus the recording material P is turned upside down. In such a process, a toner image serving as a back-face image is formed and borne on the intermediate transfer belt 10, and the toner image is transferred onto a back face of the recording material P. Through the fixing process of the fixing device 8 and the cooling process of the cooling device 9, the recording material P is discharged onto the output tray 20 by the paired output rollers 16.

The above description relates to image forming operation for forming a full color image on a recording material. In other image forming operation, a single color image can be formed by any one of the process units 1Y, 1M, 1C, and 1Bk, or a composite color image of two or three colors can be formed by two or three of the process units 1Y, 1M, 1C, and 1Bk.

Figure 2:
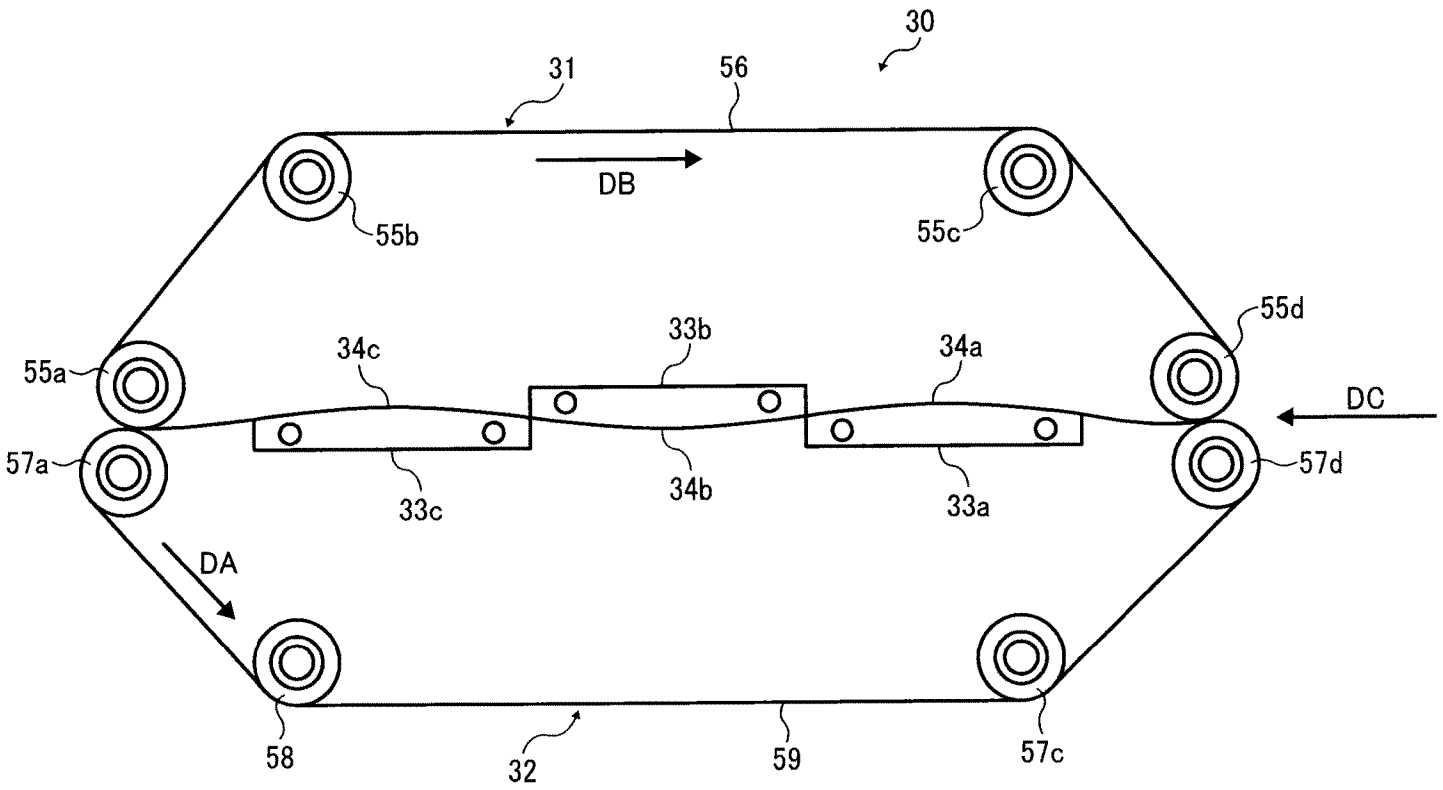
FIG. 2 is a schematic front view of a cooling device illustrated in FIG. 1.

As illustrated in FIG. 2, the cooling device 9 serving as a recording-material cooling conveyor has coolers 33 to cool a recording material P conveyed by travelling of belts of a belt conveyor 30 serving as a recording-material sandwich conveyor. The belt conveyor 30 includes a first conveyor 31 and a second conveyor 32. The first conveyor 31 is disposed at one face side (front face side or upper face side) of the recording material P. The second conveyor 32 is disposed at the other face side (back face side or lower face side) of the recording material P. Each conveyor includes the cooler(s) 33. A cooler 33*a* serving as a first cooler is disposed at the other face side (back face side or lower face side). A cooler 33*b* serving as a second cooler is disposed at the one face side (front face side or upper face side) of the recording material P. A cooler 33*c* serving as a third cooler is disposed at the other face side (back face side or lower face side) of the recording material P.

The coolers 33*a*, 33*b*, and 33*c* are disposed offset in a traveling direction of a recording material P. The cooler 33*b* at the one face side has, as a lower surface, a heat absorbing surface 34*b* of an arc surface shape slightly protruding downward. The coolers 33*a* and 33*c* at the other face side have, as upper surfaces, heat absorbing surfaces 34*a* and 34*c* of an arc surface shape slightly protruding upward. Each of the coolers 33*a*, 33*b*, and 33*c* includes a cooling-liquid channel through which cooling liquid flows.

Figure 3:
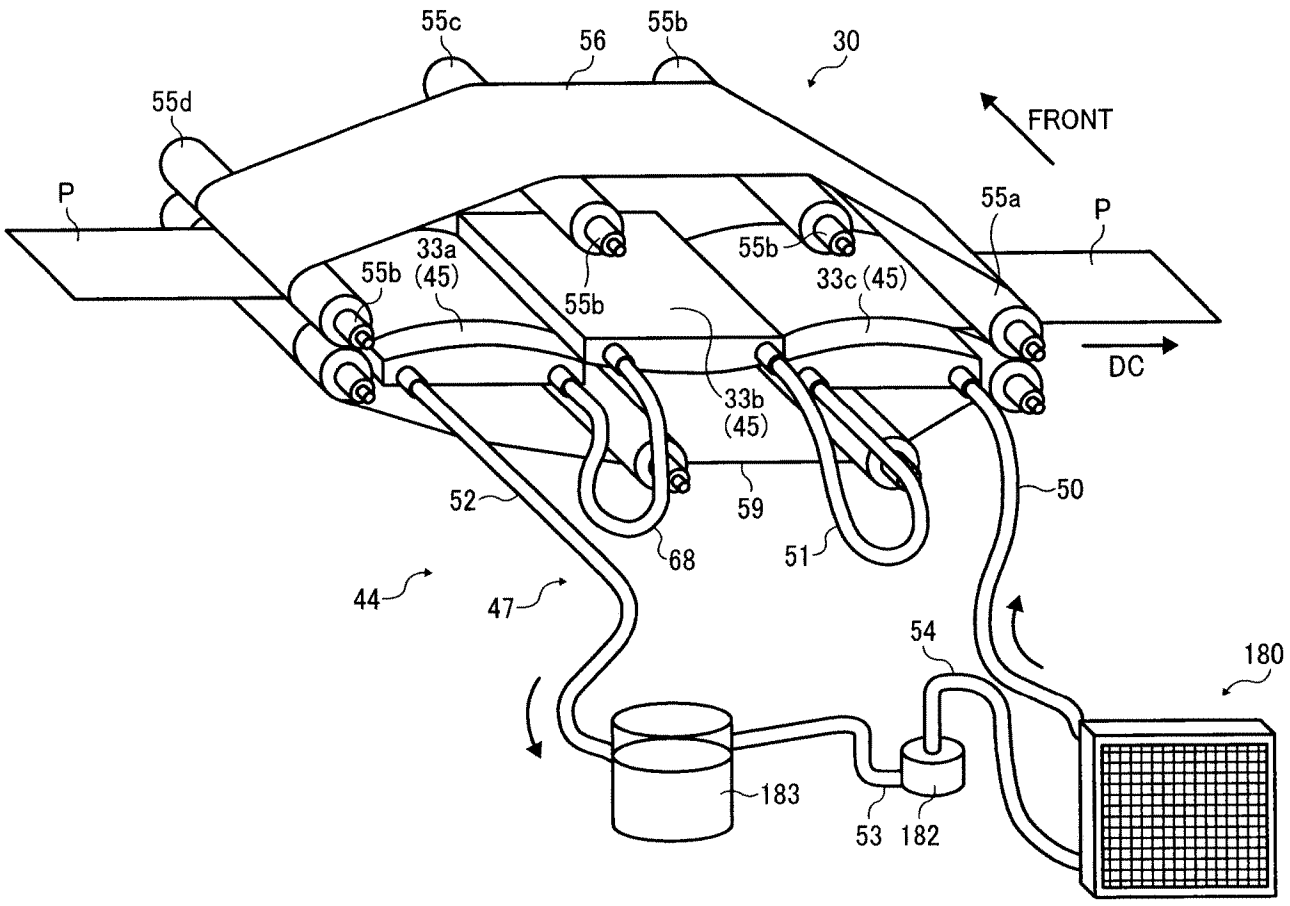
FIG. 3 is a perspective view of the cooling device of FIG. 2 seen from a rear face side thereof.

In other words, as illustrated in FIG. 3, the cooling device 9 has a cooling-liquid circuit 44. The cooling-liquid circuit 44 includes heat receivers 45 to receive heat from a recording material P serving as a heat generator, a heat radiator 180 to radiate heat of the heat receivers 45, and a circulation channel 47 to circulate cooling liquid through the heat receivers and the heat radiator 180. The circulation channel 47 includes a pump 182 to circulate cooling liquid and a liquid tank 183 to store cooling liquid. Each of the coolers 33*a*, 33*b*, and 33*c* functions as the heat receiver 45. The heat radiator 180 includes, e.g., a radiator. The cooling liquid is, for example, magnetic fluid. The magnetic fluid includes, e.g., water, hydrocarbon oil, or fluorine oil as medium and ferromagnetic ultrafine particles, such as high concentration of magnetite, dispersed in stable state in the medium. Additionally, surface-active agent is chemically adsorbed to surfaces of the ferromagnetic ultrafine particles.

The circulation channel 47 includes pipes 50, 68, 51, 52, 53, and 54. The pipe 50 connects a second opening of the cooler 33*c* to the heat radiator 180. The pipe 68 connects a second opening of the cooler 33*a* to a first opening of the cooler 33*b*. The pipe 51 connects a second opening of the cooler 33*b* to a first opening of the cooler 33*c*. The pipe 52 connects a first opening of the cooler 33*a* to the liquid tank 183. The pipe 53 connects the liquid tank 183 to the pump 182. The pipe 54 connects the pump 182 to the heat radiator 180.

The first conveyor 31 includes the plurality of rollers 55 (e.g., four driven rollers 55*a*, 55*b*, 55*c*, 55*d* in FIG. 2) and the belt (conveyance belt) 56 wound around the plurality of rollers 55. The second conveyor 32 includes a plurality of driven rollers 57*c*, 57*d*, 58 (e.g., three driven rollers in FIG. 2), a driving roller 57*a*, and the belt (conveyance belt) 59 wound around the driving roller 57*a* and the plurality of driven rollers 57*c*, 57*d*, and 58.

Accordingly, a recording material P is sandwiched and conveyed by the belt 56 of the first conveyor 31 and the belt 59 of the second conveyor 32. In other words, as illustrated in FIG. 2, the belt 59 is traveled in a direction indicated by arrow DA by driving of the driving roller 57*a*. With travel of the belt 59, the belt 56 of the first conveyor 31 is traveled in a direction indicated by arrow DB via the recording material P sandwiched between the belts 56 and 59. Thus, the recording material P is conveyed from an upstream side to a downstream side in the transport direction indicated by the arrow DC in FIG. 2.

Next, operation of the cooling device having the above-described configuration is described below.

When the recording material P is sandwiched and conveyed by the belts 56 and 59, as illustrated in, e.g., FIG. 2, the first conveyor 31 and the second conveyor 32 are placed adjacent to each other. In a state in which illustrated in FIG. 2, if the driving roller 57*a* of the second conveyor 32 is rotated, as described above, the belts 56 and 59 travel in the directions indicated by the arrows DA and DB, respectively, to transport the recording material P indicated in the transport direction indicated by the arrow DC. In such a state, cooling liquid is circulated in the cooling-liquid circuit 44. In other words, the pump 182 is activated to flow the cooling liquid through the cooling liquid channels of the coolers 33*a*, 33*b*, and 33*c*.

At this time, an inner surface of the belt 56 of the first conveyor 31 slides over the heat absorbing surface 34*b* of the cooler 33*b*, and an inner surface of the belt 59 of the second conveyor 32 slides over the heat absorbing surface 34*a* of the cooler 33*a* and the heat absorbing surface 34*c* of the cooler 33*c*. From a front surface (upper surface) side of the recording material P, the cooler 33*b* absorbs heat of the recording material P via the belt 56. From a back surface (lower surface) side of the recording material P, the cooler 33*c* and the cooler 33*a* absorb heat of the recording material P via the belt 59. In such a case, an amount of heat absorbed by the coolers 33*a*, 33*b*, and 33*c* is transported to the outside by the cooling liquid, thus maintaining the coolers 33*a*, 33*b*, and 33*c* at relatively low temperatures.

In other words, by driving the pump 182, the cooling liquid is circulated through the cooling-liquid circuit 44. The cooling liquid flows through the cooling-liquid channels of the coolers 33*a*, 33*b*, and 33*c*, absorbs heat of the coolers 33*a*, 33*b*, and 33*c*, and turns into a relatively high temperature. The cooling liquid at high temperature passes through the radiator serving as the heat receiver 45, and heat of the cooling liquid is radiated to outside air, thus reducing the temperature of the cooling liquid. The cooling liquid at relatively low temperature flows through the cooling-liquid channels again, and the coolers 33*a*, 33*b*, and 33*c* act as heat radiators. By repeating the above-described cycle, the recording material P is cooled from both sides thereof.

Next, opening and closing mechanism of an upper unit 60 and a lower unit 80 is described below.

Figure 4:
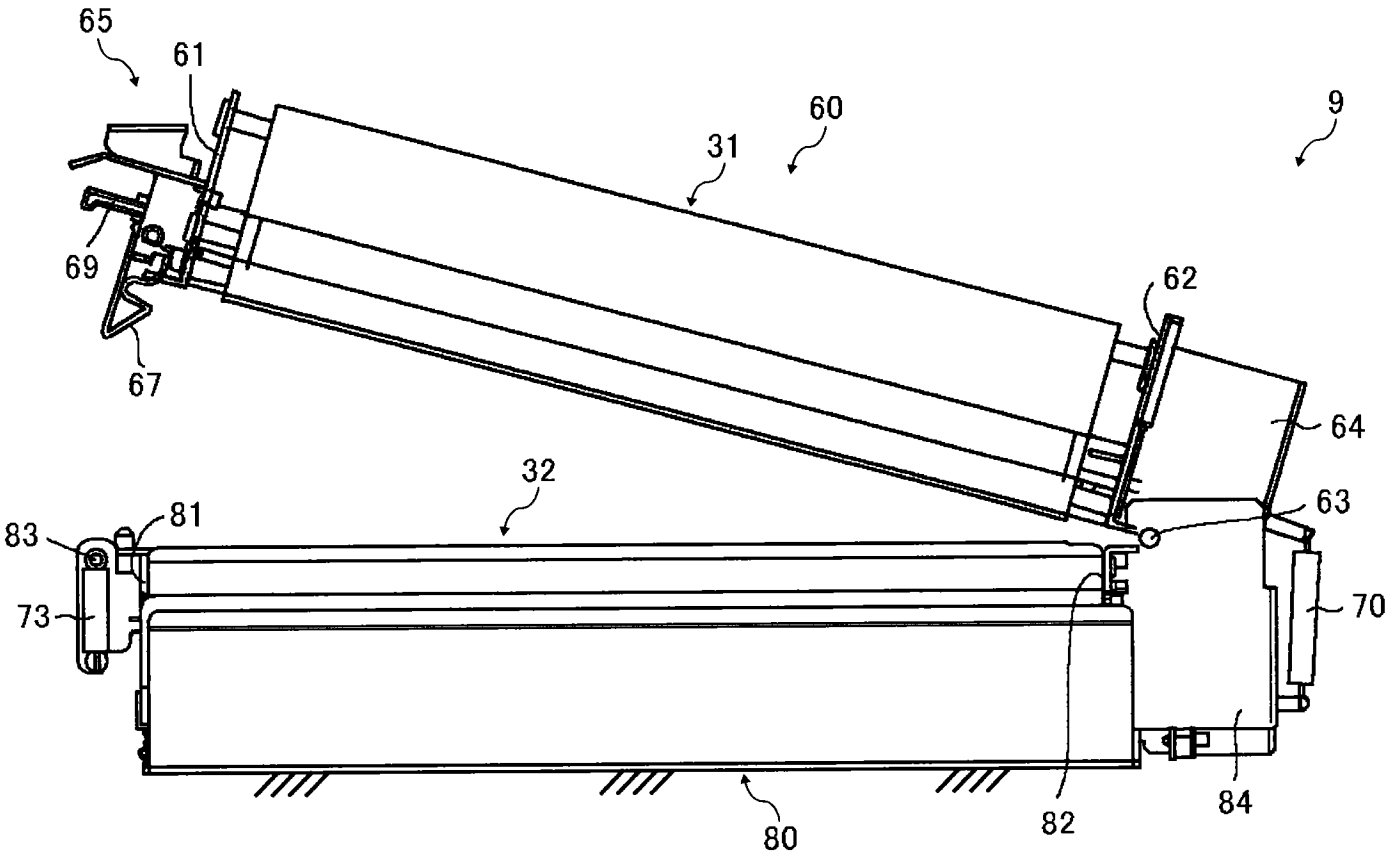
FIG. 4 is a side view of the cooling device in a state in which an upper unit is open.

As illustrated in FIG. 4, the upper unit 60 includes a pair of plates, i.e., a front side plate 61 and a rear side plate 62. Both lateral ends of a shaft of each of the rollers 55*a*, 55*b*, 55*c*, and 55*d* constituting the first conveyor 31 illustrated in FIG. 2 are rotatably supported with the front side plate 61 and the rear side plate 62. Between the front side plate 61 and the rear side plate 62, the cooler 33*b* (not seen in FIG. 4) is fixed at a portion corresponding to the position thereof illustrated in FIG. 2.

The lower unit 80 includes a pair of plates, i.e., a front side plate 81 and a rear side plate 82. Both lateral ends of a shaft of each of the rollers 57*a*, 57*c*, 57*d*, and 58 constituting the second conveyor 32 illustrated in FIG. 2 are rotatably supported with the front side plate 81 and the rear side plate 82. Between the front side plate 81 and the rear side plate 82, the coolers 33*a* and 33*c* (not seen in FIG. 4) is fixed at portions corresponding to the positions thereof illustrated in FIG. 2. Each of the front side plate 61 and the rear side plate 62 of the upper unit 60 is made of sheet metal.

An upper bracket 64 made of sheet metal is fixed on the rear side plate 62 constituting part of the upper unit 60, and serves as a mount on which a rear shaft 63 is mounted. The rear shaft 63 is a separator to move the belt conveyor 30 from a sandwiching state to a separation state, and has a shape of long round bar.

A spring 70, e.g., tension spring is latched on the upper bracket 64 and a lower bracket 84. The spring 70 acts as a pressure member to press the first conveyor 31 via the upper unit 60 in a direction to take a separation position illustrated in FIG. 4.

The lower bracket 84 made of sheet metal is fixed on the rear side plate 82 constituting part of the lower unit 80, and the rear shaft 63 is rotatably mounted on the lower bracket 84.

At the front side of the upper unit 60 and the lower unit 80 is disposed a lock assembly 65 serving as a fixer to fix a position of the first conveyor 31 of the upper unit 60 in a direction opposing the second conveyor 32 of the lower unit 80. The lock assembly 65 holds the first conveyor 31 of the upper unit 60 in an opposed position, and includes, e.g., a lock lever 67 and a grip 69.

A front shaft 83 has a shape of long round bar. One end of a spring 83 serving as a tension spring is latched on each of an upstream end and a downstream end of the front shaft 83 in a recording-material conveyance direction.

A user handles the grip 69 of the lock assembly 65, unlocks and releases the lock lever 67 engaging the front shaft 83, and opens the upper unit 60 upward. Thus, as illustrated in FIG. 4, the upper unit 60 rotates around the rear shaft 63. At this time, a moment is generated by a biasing force of the spring 70 contracted with the rear shaft 63 acting as a fulcrum, to hold the upper unit 60 at the separation position in a full open state.

Next, the user takes, e.g., the grip 69 of the lock assembly 65 or a front end of the upper unit 60 and rotates the upper unit 60 in a closing direction against the moment of the biasing force of the spring 70. As the upper unit 60 is rotated downward, the upper unit 60 rotates around the rear shaft 63 as a rotation center.

The user handles the grip 69 of the lock assembly 65 so that the upper unit 60 becomes the full open sate, and engages the lock lever 67 with the front shaft 83.

Figure 5:
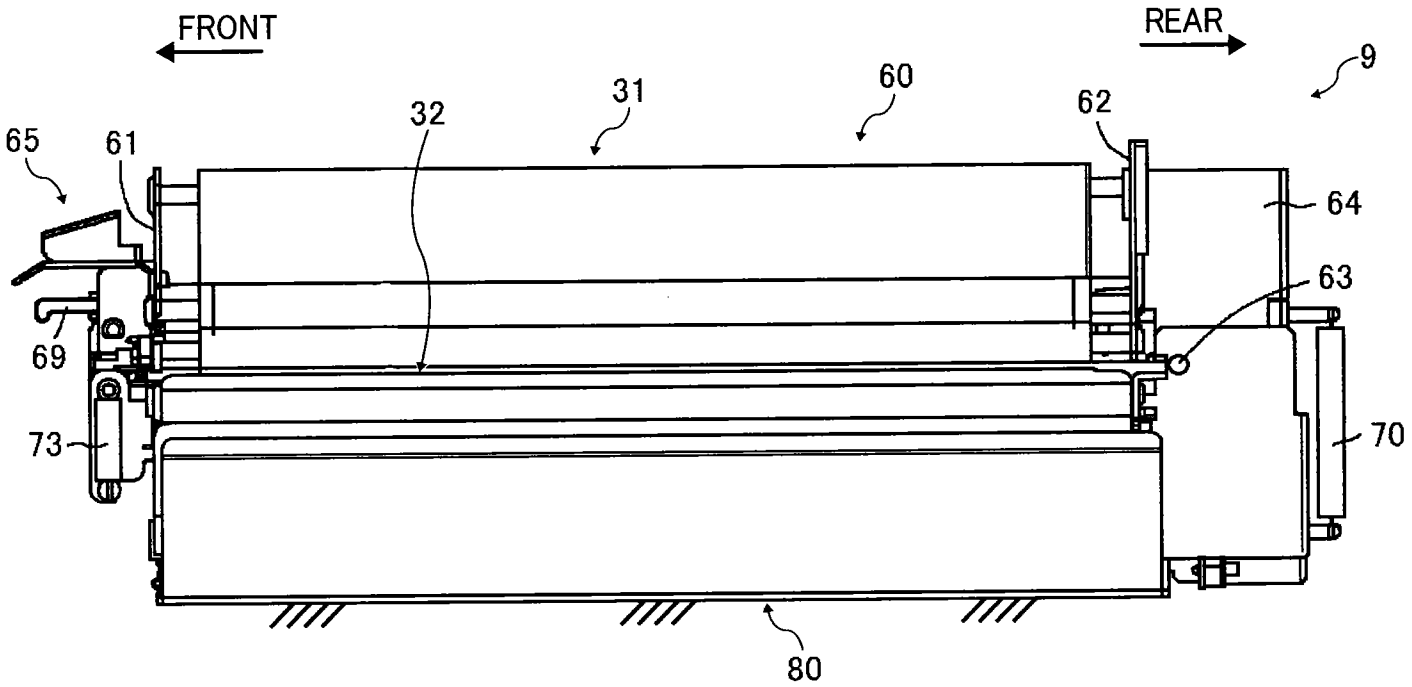
FIG. 5 is a side view of the cooling device in a state in which the upper unit is closed.

When the lock lever 67 engages the front shaft 83, as illustrated in FIG. 5, the upper unit 60 is placed at the opposed position. In other words, the upper unit 60 is pulled vertically downward by a biasing force of a spring 73, and the positions of the upper unit 60 and the lower unit 80 in an upward and downward direction are determined at the font side of the upper unit 60 and the lower unit 80.

As illustrated in FIGS. 4 and 5, the cooling device 9 serving as the recording-material cooling conveyor according to this embodiment has a configuration in which a front side thereof in the image forming apparatus 1000 moves upward and downward around a rear side thereof as a rotation fulcrum.

Next, a configuration of the heat radiator 180 disposed at a rear side of the cooling device 9 according to this embodiment is described below.

Figure 6:
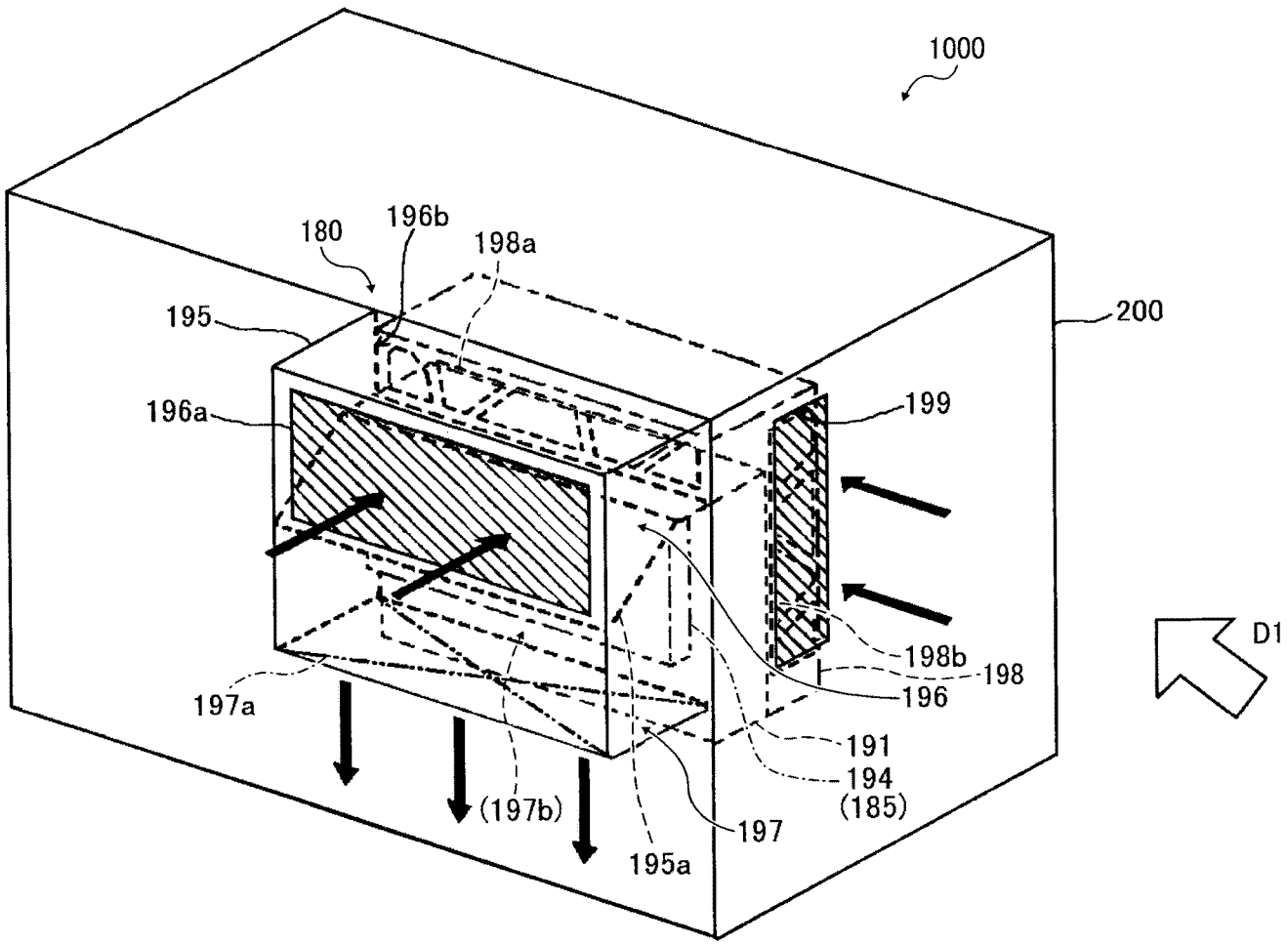
FIG. 6 is a back perspective view of an image forming apparatus.
Figure 7:
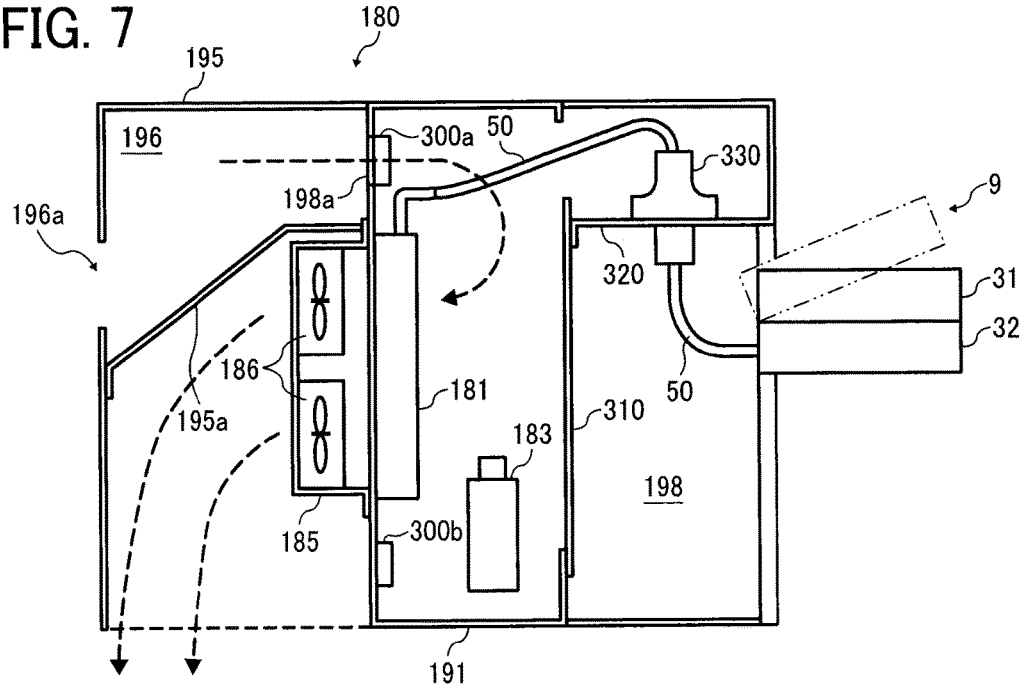
FIG. 7 is a schematic view of the image forming apparatus in a direction indicated by arrow D1 in FIG. 6.

FIG. 6 is a perspective view of the image forming apparatus 1000 according to this embodiment, seen from a back side thereof. FIG. 7 is a schematic view of the image forming apparatus 1000 in a direction indicated by arrow D1 in FIG. 6.

First, with reference to FIG. 6, an arrangement of the heat radiator 180 and a relation of an external duct 195, an internal duct 191, an interior duct 198 in an apparatus body 200 of the image forming apparatus 1000, and an exterior panel are described below.

As illustrated in FIG. 6, in the apparatus body 200, the heat radiator 180 is disposed near a portion at which a rear side face and a left side face of the exterior panel of the apparatus body 200 contact each other. Such an arrangement of the heat radiator 180 facilitates intake of outside air from a first interior opening 198*a* and a second interior opening 198*b* serving as two internal openings into the apparatus body 200 and emission of internal air from a fan mount openings 194*b* of a fan unit 185 to the outside of the apparatus body 200.

Specifically, the fan unit 185 protrudes beyond a rear side of the apparatus body 200, and the first interior opening 198*a* of the interior duct 198 is disposed above the fan unit 185.

The second interior opening 198*b* of the interior duct 198 at a front side of the internal duct 191 is disposed facing the right side face of the apparatus body 200 illustrated in FIG. 6. The external duct 195 is connected to a rear side of the first interior opening 198*a* and the fan unit 185. Outside air is guided to the first interior opening 198*a* from the rear side of the apparatus body 200, and the wind blowing from the fan unit 185 is guided downward at the rear side of the apparatus body 200. The exterior panel at the right side of the apparatus body 200 illustrated in FIG. 6 facing the second interior opening 198*b* has an opening to guide outside air from the right side of the apparatus body 200 to the second interior opening 198*b*.

For the external duct 195, an upper side wall, a left side wall, and a right side wall have no opening through which the wind passes. A rear side wall has a first external opening 196*a* at an upper side thereof, and a second external opening 197*a* at a lower side thereof. An external-duct partition 195*a* partitions a first external duct portion 196 through which the wind sucked from the first interior opening 198*a* passes from a second external duct portion 197 serving as an external duct through which the wind is blown out from the fan unit 185 serving as a blower.

At a side of the first external duct portion 196 facing the internal duct 191, a first external communication opening 196*b* connected to the side walls of the interior duct 198 and the internal duct 191 around the first interior opening 198*a* is formed with the external-duct partition 195*a* and three walls of the external duct 195.

The first external opening 196*a* includes multiple long holes to suppress inflow of, e.g., foreign substances while allowing passing of the outside air. Such a configuration of the first external duct portion 196 allows formation of a channel of the outside air sucked into the internal duct 191 from a rear side space of the external duct 195 protruding rearward of the image forming apparatus 1000, via the first interior opening 198*a*.

At a side of the second external duct portion 197 facing the internal duct 191, a second external communication opening 197*b* connected to a side wall of the internal duct 191 around the fan unit 185 via three walls is formed with the external-duct partition 195*a* and two side walls of the external duct 195. The second external communication opening 197*b* is communicated with the second external opening 197*a* that is a lower opening of the second external duct portion 197. The second external opening 197*a* in this embodiment includes a wire mesh to suppress inflow of, e.g., foreign substances while allowing passing of the air. Such a configuration of the second external duct portion 197 allows formation of a channel through which the fan unit 185 emits the outside air from the internal duct 191 into a lower space of the external duct 195 protruding rearward of the apparatus body 200.

A slit panel 199 including multiple slits to suppress inflow of foreign substances while allowing passing of the outside air is mounted at an opening disposed in the right-side exterior panel of the apparatus body 200 facing the second interior opening 198*b* of the interior duct 198. Such a configuration of the surroundings of the second interior opening 198*b* allows formation of a channel of the outside air sucked from a left side space of the apparatus body 200 into the internal duct 191 via the second interior opening 198*b*. The slit panel 199 facing the second interior opening 198*b* preferably includes a partition connected to the side wall of the interior duct 198 having the second interior opening 198*b* to prevent inflow of the air from other spaces in the apparatus body 200.

As illustrated in FIGS. 6 and 7, the interior duct 198 is disposed at the front side of the internal duct 191 to allow passing of the wind sucked into the internal duct 191. The internal duct 191 is a substantially rectangular parallelepiped and has a rear side wall connected to the fan unit 185.

The fan unit 185 includes a fan duct 194 and eight blowing fans 186. For the fan unit 185, each of the blowing fans 186 is mounted on a corresponding one of the eight fan mount openings 194*b* (see FIG. 8) disposed at a rear side wall of the fan duct 194. The closed state of the first conveyor 31 and the second conveyor 32 illustrated in FIG. 5 corresponds to a solid line of FIG. 7. A broken line of FIG. 7 indicates a state of the first conveyor 31 separated from the second conveyor 32 and corresponds to FIG. 4.

FIGS. 8 through 18 are described below.

Figure 8:
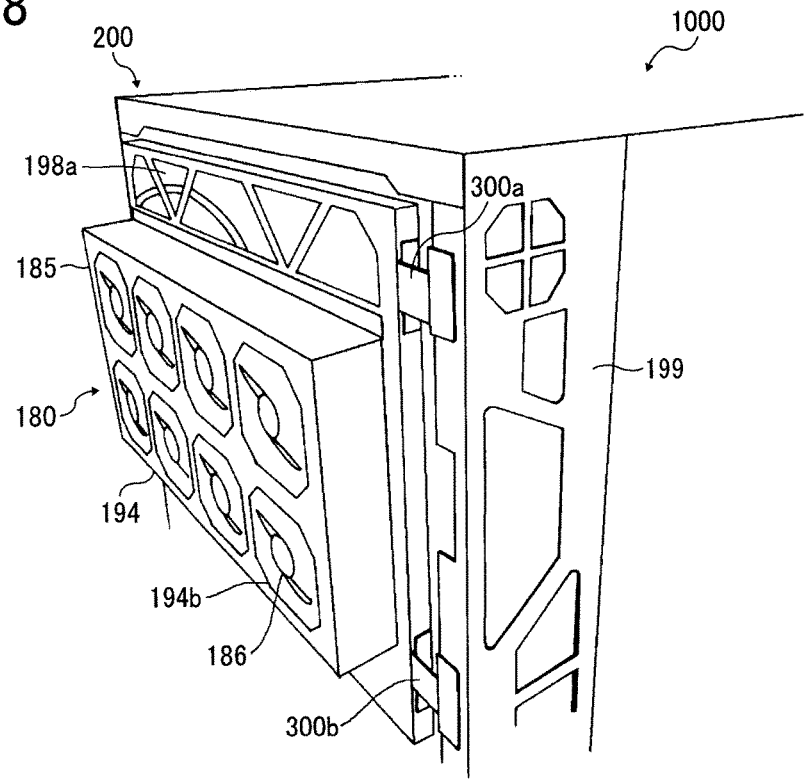
FIG. 8 is a back perspective view of the image forming apparatus.
Figure 9:
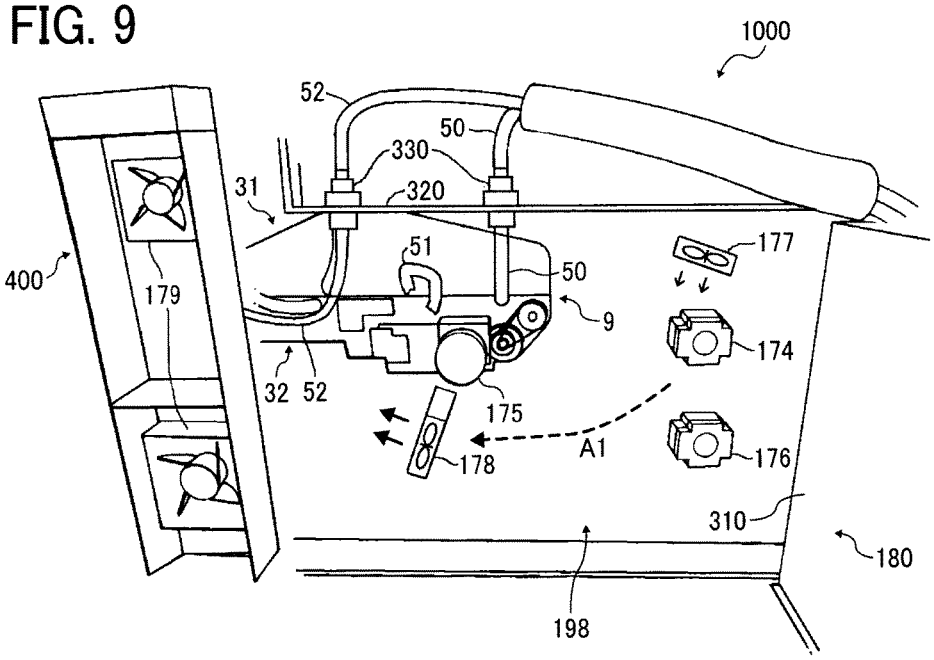
FIG. 9 is a back view of the image forming apparatus in a state in which a heat radiator is open.
Figure 10:
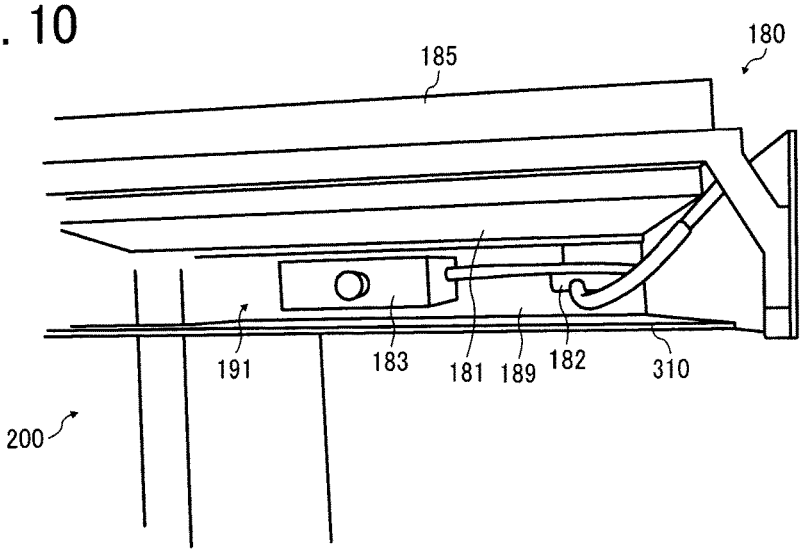
FIG. 10 is a plan view of the heat radiator opened.
Figure 11A:
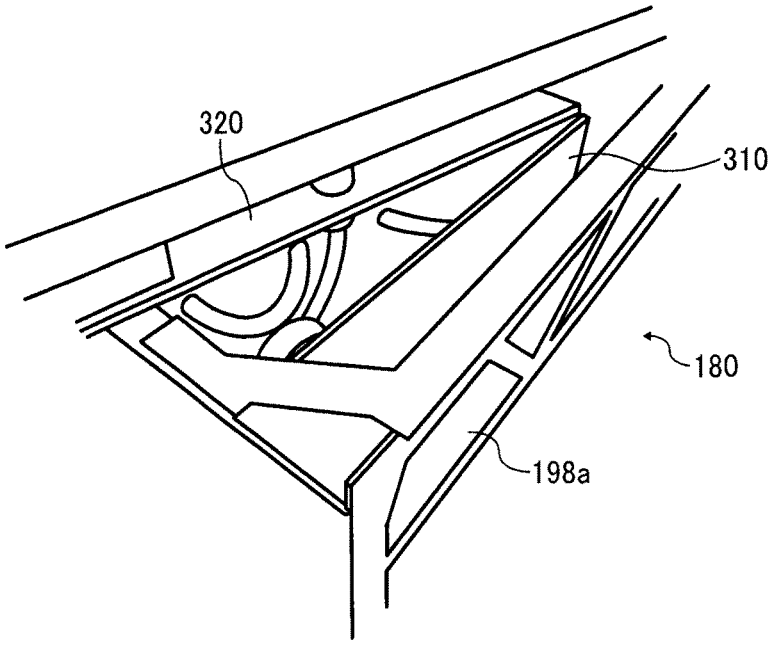
FIGS. 11A and 11B are a side wall and an upper structure.
Figure 11B:
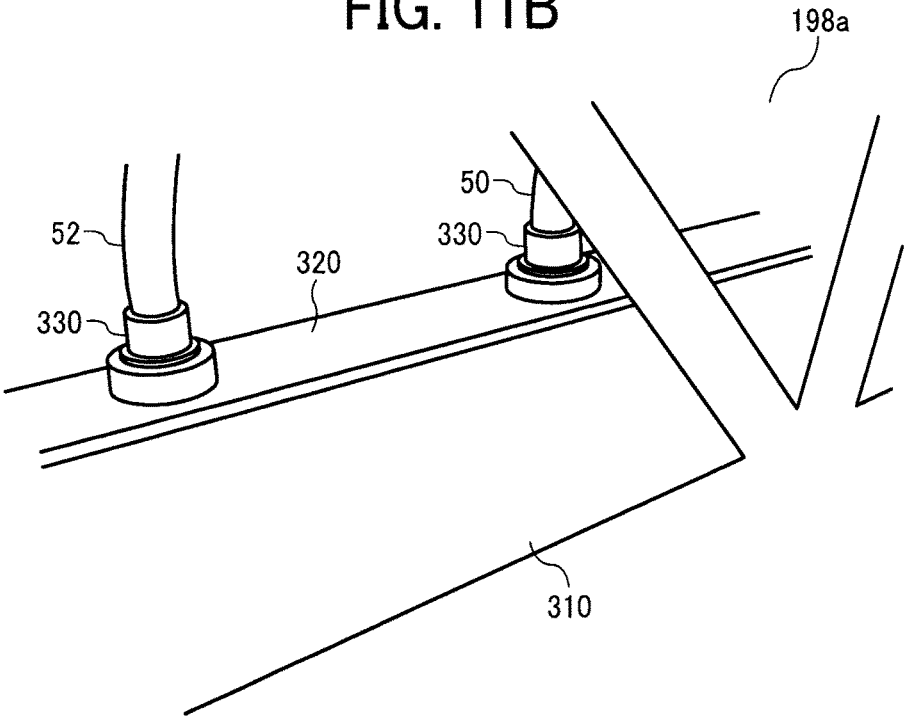
Figure 12:
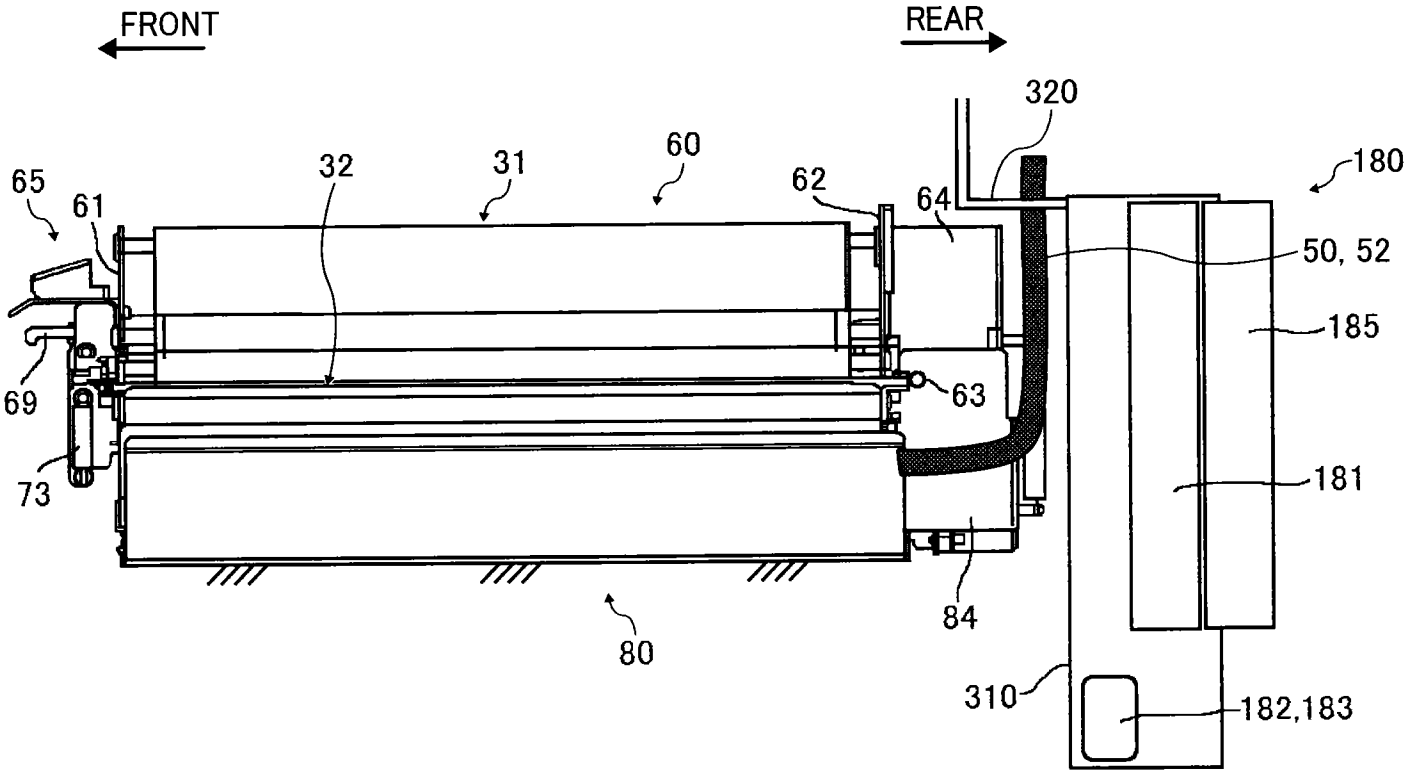
FIG. 12 is a side view of a cooling device in a closed state.
Figure 13:
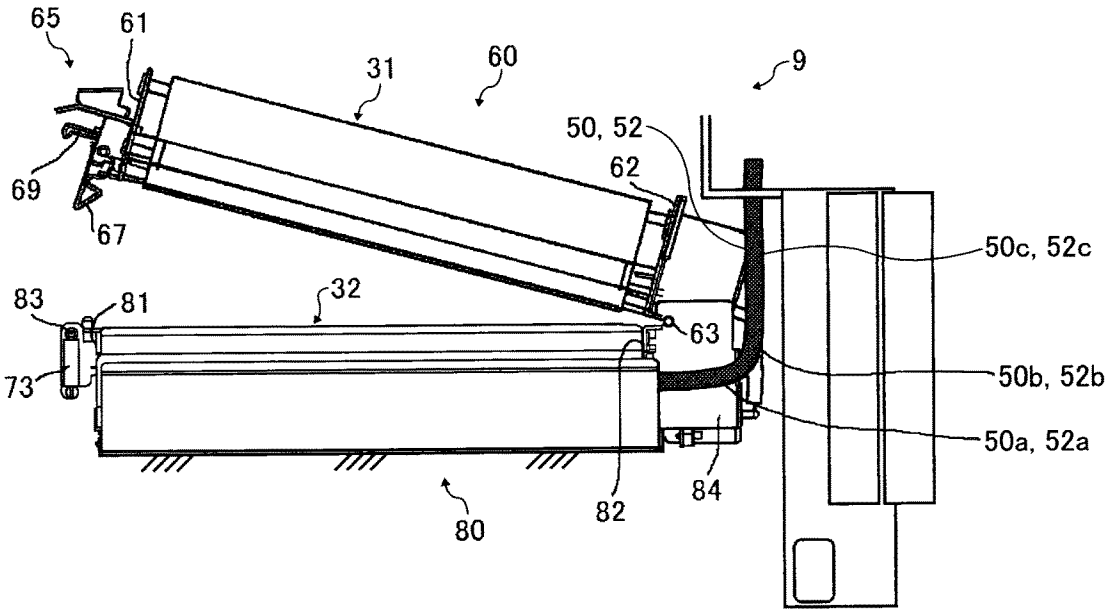
FIG. 13 is a side view of a cooling device in an open state.

FIG. 8 is a back perspective view of the image forming apparatus 1000. FIG. 9 is a back view of the image forming apparatus 1000 in a state in which the heat radiator 180 is open. FIG. 10 is a plan view of the heat radiator 180 opened. FIGS. 11A and 11B are a side wall 310 and an upper structure 320. FIGS. 12 and 13 are side views of a closed state and an open state, respectively, of the cooling device 9.

As illustrated in FIG. 8, the heat radiator 180 is rotatably supported on a structure of the apparatus body 200 with rotary shafts 300*a* and 300*b*. FIG. 8 shows a state in which the external duct 195 is removed and the fan unit 185, the fan mount opening 194*b*, and the blowing fans 186 are visible. As illustrated in FIGS. 9 and 10, the heat radiator 180 has the side wall 310 at a side face facing the rear face side of the apparatus body 200. The heat radiator 180 is a single unit including a radiator 181 to cool cooling liquid, the pump 182 to circulate the cooling liquid, the liquid tank 183 to store the cooling liquid, and the fan unit 185 to generate air flow passing the radiator 181.

As illustrated in FIGS. 9 and 10, the side wall 310 of the heat radiator 180 is a shield plate to shield the radiator 181 from a driving system of the apparatus body 200. The driving system includes a driving motor 174 to rotate the paired output rollers 16 (see FIG. 1), a driving motor 175 to rotate the driving roller 57*a* of the second conveyor 32 (FIG. 2), a driving motor 176 to drive the feed rollers 28 of the reverse recording-material transport passages 26 and 29 (see FIG. 1), and a motor driving board to control the driving motors 174, 175, and 176. The heat radiator 180 also includes a fan 177 and a fan 178. The fan 177 blows air toward the driving motors 174 and 176 and a lower side of the image forming apparatus 1000. The fan 178 blows the air blown by the fan 177, further to the left side of the image forming apparatus 1000. The fans 177 and 178 serving as the blowers generate air flow (indicated by arrow A1) entirely in an interior space (the interior duct 198) formed with the side wall 310 closed and the rear face of the image forming apparatus 1000, thus cooling the driving system which is likely to retain heat. In FIG. 9, a ventilation duct 400 is disposed adjacent to the cooling device 9. The ventilation duct 400 is disposed between the fixing device 8 and the cooling device 9 to create an air flow that is emitted from the fixing device 8 and includes vapor from a recording material P during fixing. The air flow is generated by suction of air with fans 179 disposed at a back face of the ventilation duct 400, guided toward the rear face of the image forming apparatus illustrated in FIG. 9, and discharged to the outside of the image forming apparatus. At this time, an air flow in the interior duct 198 formed by the side wall 310 closed and the rear face of the image forming apparatus is also emitted by the fans 179 to the outside of the image forming apparatus. The pipe 50 is connected to the second conveyor 32 that is a fixed side, thus allowing the driving system including the driving motor 175 to be disposed adjacent to a connecting portion of the pipe 50 with the second conveyor 32 as illustrated in FIG. 9.

In other words, if the pipe 50 is connected to the first conveyor 31 which is rotated, the connecting portion of the pipe 50 moves with opening and closing of the first conveyor 31. Accordingly, other components are not disposed within a movement range of the connecting portion, thus reducing the degree of freedom of the arrangement of components and increasing the space (the size of the apparatus).

In FIG. 10, the radiator 181, the pump 182, and the liquid tank 183 to cool the cooling liquid having passed the heat receiver are accommodated in a receiving part 189 of the internal duct 191 of the heat radiator 180. The radiator 181 includes multiple vents. When the blowing fans 186 of the fan unit 185 are rotated, an air flow is generated from the inside of the internal duct 191 to the outside of the image forming apparatus. The radiator 181 includes a pipe through which the cooling liquid flows in a lateral direction in FIG. 10. When the air flow passes the vents of the radiator 181 from a lower side to an upper side in FIG. 10, the cooling liquid heated by passing the coolers is cooled.

The receiving part 189 receives cooling liquid leaked from components, such as the radiator 181, the pump 182, and the liquid tank 183 accommodated in the internal duct 191. Such a configuration can suppress occurrence of a failure due to wetting of a recording material P or other components, such as reverse recording-material transport passages of the image forming apparatus 1000 including the cooling device 9.

FIG. 11A illustrates a midway state in which the heat radiator 180 is rotated by the rotary shafts 300*a* and 300*b* (see FIG. 8) for closing from the open state of FIG. 10. As described above, the heat radiator 180 can approach and separate from the belt conveyor 30 together with the radiator 181. When the heat radiator 180 is further rotated in a closing direction from the state of FIG. 11A, as illustrated in FIG. 11B, the side wall 310 and the upper structure 320 contact each other. Contacting the side wall 310 with the upper structure 320 separates the radiator 181 from the driving system or the cooling device 9. Such a configuration prevents cooling liquid from attaching the driving system or the cooling device 9 even if the cooling liquid leaks in the heat radiator 180.

By closing the heat radiator 180, a rear side space of the image forming apparatus 1000 is closed with the side wall 310 and the upper structure 320, thus forming the interior duct 198 (FIGS. 6, 7, and 9). Accordingly, the slit panel 199 is communicated with the interior duct 198 (FIG. 6), thus allowing inflow of air from the outside of the image forming apparatus to the interior duct 198 and cooling the driving system.

As illustrated in FIGS. 12 and 13, the pipes 50 and 52 include connecting portions 50*a* and 52*a*, bending portions 50*b* and 52*b*, and channel shift portions 50*c* and 52*c*, respectively. The connecting portions 50*a* and 52*a* extend rearward of the image forming apparatus 1000 and is connected to the heat receiver 45 at the rear side of the second conveyor 32. The bending portions 50*b* and 52*b* bend upward from the connecting portions 50*a* and 52*a*. The channel shift portions 50*c* and 52*c* extend upward from the bending portions 50*b* and 52*b* to the upper structure 320. The first conveyor approaches and separates from the second conveyor via the rear shaft 63. The channel shift portions 50*c* and 52*c* faces the first conveyor 31 (specifically, the rear side plate 62). The connecting portions 50*a* and 52*a* extend horizontally (or in the same direction as an axial direction of each of the rollers 55*a*, 55*b*, 55*c*, and 55*d* constituting the first conveyor 31). The channel shift portions 50*c* and 52*c* extend vertically (in a direction perpendicular to an axis of each of the rollers 55*a*, 55*b*, 55*c*, and 55*d* or a top and bottom direction of the apparatus). The pipe 50 is disposed at a position more rearward than each of the upper bracket 64 and the lower bracket 84 (more rearward in a direction passing through a sheet face on which FIG. 2 or 13 is printed). The pipe 52 is disposed at a position more forward than each of the upper bracket 64 and the lower bracket 84 (more forward in the direction passing through a sheet face on which FIG. 2 or 13 is printed). Accordingly, the approach and separation of the first conveyor 31 do not cause the channel shift portions 50*c* and 52*c* to impinge the upper bracket 64 and the lower bracket 84.

The channel shift portions 50*c* and 52*c* are disposed within a width of each of the first conveyor 31 and the second conveyor 32 (in the lateral direction in FIG. 9).

Openings of the connecting portions 50*a* and 52*a* are directed to the front side of the image forming apparatus, and a direction in which each of the connecting portions 50*a* and 52*a* is connected is a back and forth direction of the image forming apparatus. The pipes 50 and 52 are connected to the second conveyor 32 which is a fixed-side conveyor. Accordingly, even when the first conveyor 31 is opened upward as illustrated in FIG. 13, the pipes 50 and 52 do not deform, thus reducing stress against the connecting portions 50*a* and 52*a*. As a result, such a configuration suppresses damage to or leakage of cooling liquid from the connecting portions 50*a* and 52*a* of the pipes 50 and 52.

The second conveyor 32 is disposed below the first conveyor 31, thus allowing an increase in length of the channel shift portions 50*c* and 52*c*. Such a configuration reduces stress against the pipes which might be otherwise caused by the connecting portions 50*a* and 52*a* and the bending portions 50*b* and 52*b*.

As illustrated in FIG. 13, the channel shift portions 50*c* and 52*c* are arranged so as not to impinge the rear side plate 62 of the first conveyor 31 when the first conveyor 31 is open. The channel shift portions 50*c* and 52*c* face the side face of the heat receiver of the first conveyor 31. The belt conveyor 30 is moved with the upper bracket 64 to approach and separate from the channel shift portions 50*c* and 52*c*. However, the channel shift portions 50*c* and 52*c* are disposed away from a movement range of the belt conveyor 30 (or the rear side plate 62) with the upper bracket 64. The channel shift portions 50*c* and 52*c* are arranged so as not to impinge the side wall 310 of the heat radiator 180 when the heat radiator 180 is closed. In other words, the channel shift portions 50*c* and 52*c* are disposed away from a movement range of the heat radiator 180. Such a configuration suppresses damage to the pipes 50 and 52. Such a configuration also prevents a reduction in maintenance space which might be caused if the first conveyor 31 impinges the channel shift portions 50*c* and 52*c* and hampers opening of the first conveyor 31. The upper structure 320 is disposed higher than an upper end of the first conveyor 31, protrudes more rearward than the first conveyor 31, and has a substantially L shape in cross section.

Figure 14:
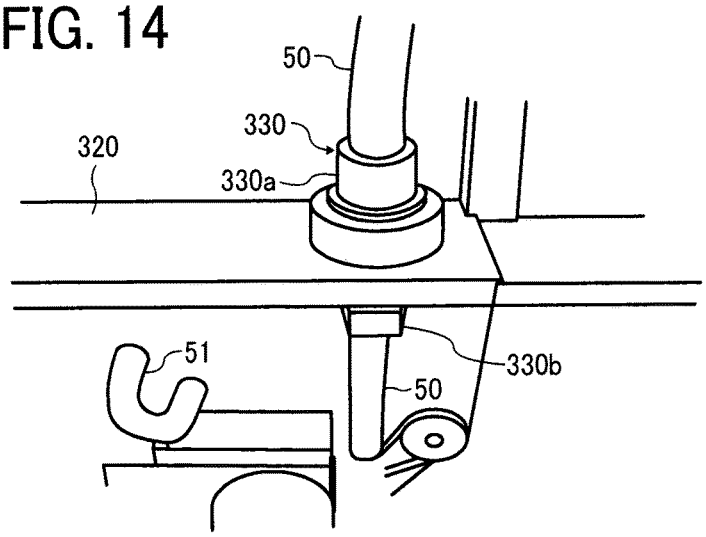
FIG. 14 is an enlarged view of a pipe fix portion illustrated in FIG. 9.

As illustrated in FIG. 9, the pipes 50 and 52 extending from the radiator 181 are turned around in a space above the upper structure 320. As illustrated in FIG. 14, a leading end of each of the pipes 50 and 52 is fixed in a pipe fix portion 330 of the upper structure 320. By contrast, a leading end of each of the pipes 50 and 52 extending from a cooling liquid channel of the heat receiver of the second conveyor 32 is removably connected to the pipe fix portion 330. The pipe fix portion 330 is a single component integrally molded with a first end 330*a* and a second end 330*b*. The first end 330*a* is positioned above the upper structure 320 and the second end 330*b* is positioned below the upper structure 320.

Figure 15:
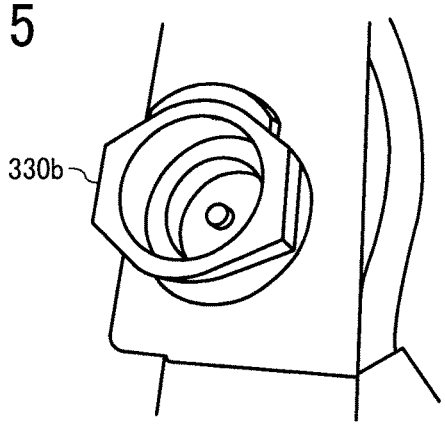
FIG. 15 is an enlarged view of a second end illustrated in FIG. 14.
Figure 16:
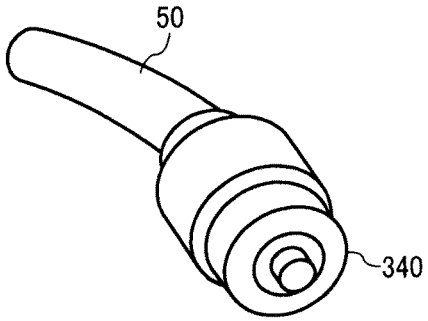
FIG. 16 is an enlarged view of a connector connected to the second end illustrated in FIG. 15.

As illustrated in FIG. 15, the second end 330*b* has a connector to connect a connector 340 (see FIG. 16) mounted on the leading end of each of the pipes 50 and 52.

Figure 17:
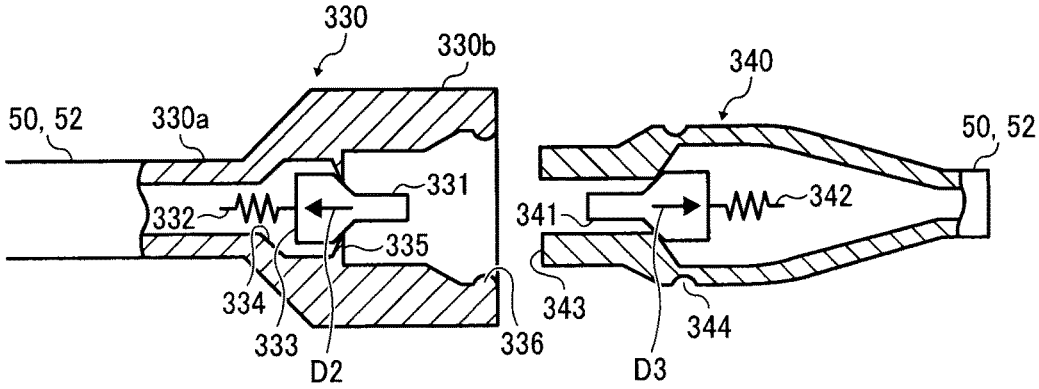
FIG. 17 is a schematic cross sectional view of a pipe fix portion and the connector.

FIG. 17 is a schematic cross sectional view of the pipe fix portion 330 and the connector 340.

The pipe fix portion 330 includes an engagement portion 331 biased rightward in FIG. 17 by a spring 332. The connector 340 includes an engagement portion 341 biased leftward in FIG. 17 by a spring 342. When the pipe fix portion 330 is not connected to the connector 340, the engagement portion 331 receives an outward biasing force from the spring 332 and the engagement portion 341 receives an outward biasing force from the spring 342, thus closing the channel of cooling liquid. By contrast, when the connector 340 is engaged into the pipe fix portion 330, a leading edge 343 of the connector 340 engages an engaged portion 335 of the pipe fix portion 330 and an inner circumferential portion of the pipe fix portion 330 engages an outer circumferential portion of the connector 340, thus determining the positions of the connector 340 and the pipe fix portion 330. At this time, the engagement portion 331 and the engagement portion 341 push each other against the biasing force of the springs 332 and 342, so that each of the engagement portion 331 and the engagement portion 341 moves inward (in a direction indicated by arrow D2 and arrow D3, respectively, in FIG. 17). A side face 333 of the engagement portion 331 contacts an inner circumferential slope 334, and as a result, movement of the engagement portion 331 is stopped. Thus, the channel of cooling liquid is open, thus allowing cooling liquid in the pipes 50 and 52 to flow through the pipe fix portion 330 and the connector 340. At this time, the connection of the pipe fix portion 330 and the connector 340 is held by a connection holding mechanism (fitting of a protrusion 336 into a recess 344.

Figure 18:
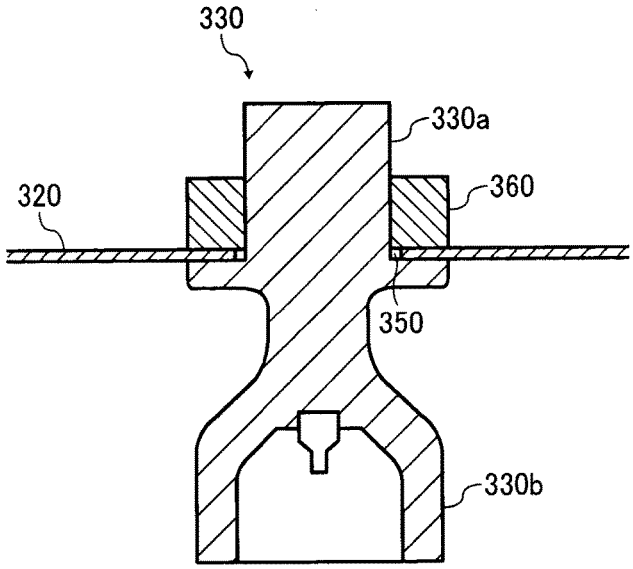
FIG. 18 is a schematic cross sectional-view of the pipe fix portion and the upper structure.

FIG. 18 is a schematic cross sectional view of the pipe fix portion 330 and the upper structure 320.

As illustrated in FIG. 18, the upper structure 320 has a hole 350 into which the first end 330*a* of the pipe fix portion 330 is inserted. A male screw is formed at an outer circumference of the first end 330*a*, and a cap 360 is fastened to the first end 330*a* having a female screw inside. Thus, the pipe fix portion 330 is fixed to the upper structure 320.

The pipe fix portion 330 is fixed to the upper structure 320 fixed at the image forming apparatus. Each of the pipes 50 and 52 is fixed at the pipe fix portion 330. Such a configuration allows the pipes 50 and 52 to be positioned without fluctuating. Accordingly, the pipes 50 and 52 do not hamper the opening and closing operation of the heat radiator 180 illustrated in FIGS. 12 and 13 or the opening operation of the belt conveyor 30 illustrated in FIGS. 12 and 13, thus suppressing damage to the pipes 50 and 52. When the leading end (the connector 340) of each of the pipes 50 and 52 extended from the heat receiver of the second conveyor 32 is disconnected from the pipe fix portion 330, the cooling device 9 is easily removable from the front side of image forming apparatus in maintenance of the cooling device 9.

Figure 19A:
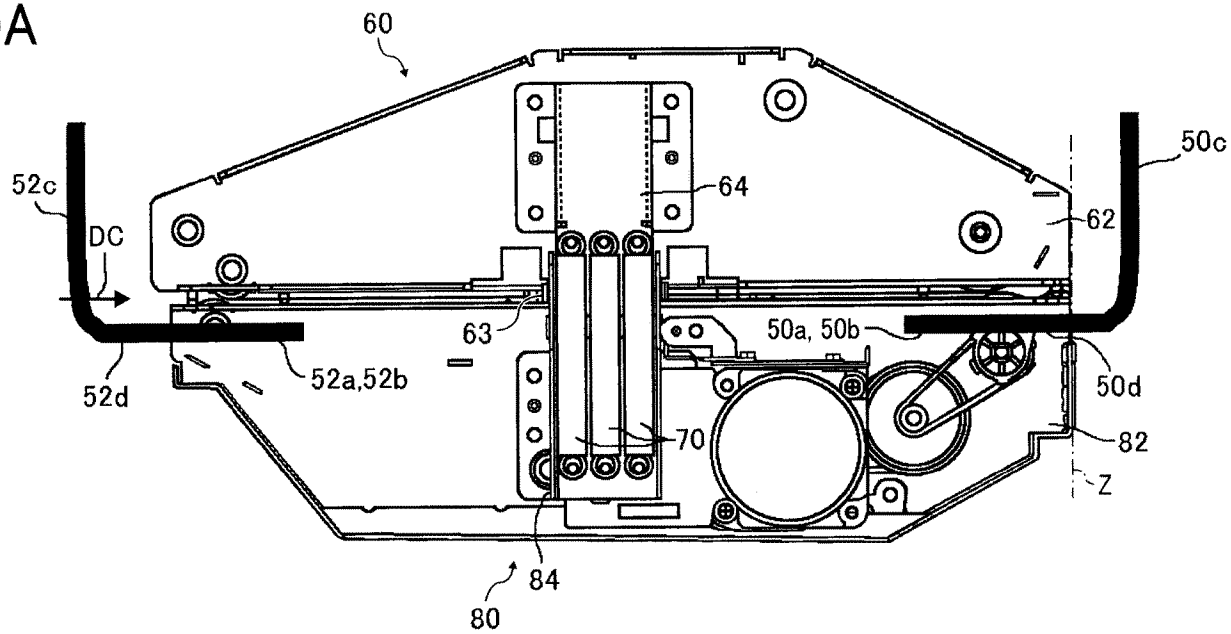
FIGS. 19A and 19B are schematic views of a variation of an arrangement of pipes.
Figure 19B:
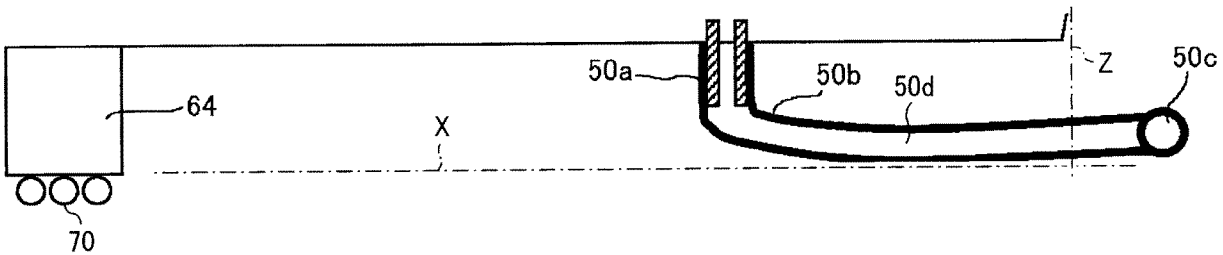

FIGS. 19A and 19B are schematic views of a variation of the arrangement of the pipes. FIG. 19A is a back view of the cooling device 9. FIG. 19B is a partial plan view of FIG. 19B.

For example, assume a case in which there is no sufficient gap between the side wall 310 (FIG. 13) of the heat radiator 180 and the first conveyor 31. Specifically, assume that, when the first conveyor 31 is open as illustrated in FIG. 13, the gap between the right side face of the first conveyor 31 (a position of a right end of the rear side plate 62) and the side wall 310 is not greater than a diameter of each of the pipes 50 and 52.

Such a configuration can further reduce the anteroposterior size of image forming apparatus. However, in such a case, if each of the pipes 50 and 52 is arranged in a route illustrated in FIG. 13, the first conveyor 31 opened might impinge the channel shift portions 50*c* and 52*c*.

Hence, in this example, the pipe 50 is turned around as illustrated in FIGS. 19A and 19B. In other words, the pipe 50 includes a connecting portion 50*a*, a bending portion 50*b*, an extending portion 50*d*, and a channel shift portion 50*c*. The connecting portion 50*a* is connected to the heat receiver at the rear side of the second conveyor 32 and extended rearward of the image forming apparatus. The bending portion 50*b* bend rightward from the connecting portion 50*a*. The extending portion 50*d* is extended along the rear face of the second conveyor 32. The channel shift portion 50*c* is bent upward and extended upward to the upper structure 320. The connector 340 mounted on the leading end of the channel shift portion 50*c* is fixed at the second end 330*b* of the pipe fix portion 330 fixed to the upper structure 320. The pipe 52 has the same configuration.

Here, as illustrated in FIG. 19B, the extending portion 50*d* is disposed more inward than a rear edge of the upper bracket 64 (indicated by line X-X) protruding from the first conveyor 31. The extending portion 50*d* is disposed in an area lower than the first conveyor 31. The channel shift portion 50*c* is bent at a position outer than a right side edge of the first conveyor 31 (indicated by line Z-Z) within a distance at which the upper bracket 64 protrudes from the first conveyor 31, and is extended upward. Such a configuration allows the side wall 310 to approach the first conveyor 31 within a range that the side wall 310 does not contact the first conveyor 31 opened. As illustrated in FIGS. 19A and 19B, such arrangement suppresses interference of the pipes 50 and 52 with the first conveyor 31 and thus does not affect opening operation of the first conveyor 31.

Next, a variation of the cooling device is described below.

The cooling device in this disclosure is not limited to a cooling device including a conveyor openable upward (the first conveyor 31) and may be a cooling device including a conveyor openable downward. In such a configuration, for example, a first conveyor 31 at an upper side is fixed, and pipes 50 and 52 are connected to the first conveyor 31.

The conveyor is not limited to a conveyor rotatable around a rotary shaft, and may be a conveyor movable upward and downward while maintaining a closed state. The cooler(s) may be provided at only the fixed-side conveyor.

When the number of heat receivers arranged is odd, e.g., a first conveyor 31 includes an odd number of heat receivers 45 and a second conveyor 32 includes an even number of heat receivers 45, as illustrated in FIG. 3, the pipes 50 and 52 of the second conveyor 32 at the fixed side can be used for input and output of cooling liquid. By contrast, when an even number of heat receivers are arranged, e.g., each of a first conveyor and a second conveyor include an even number of heat receivers, the pipes of the second conveyor 32 the fixed side can be used for input and output of cooling liquid.

Figure 20:
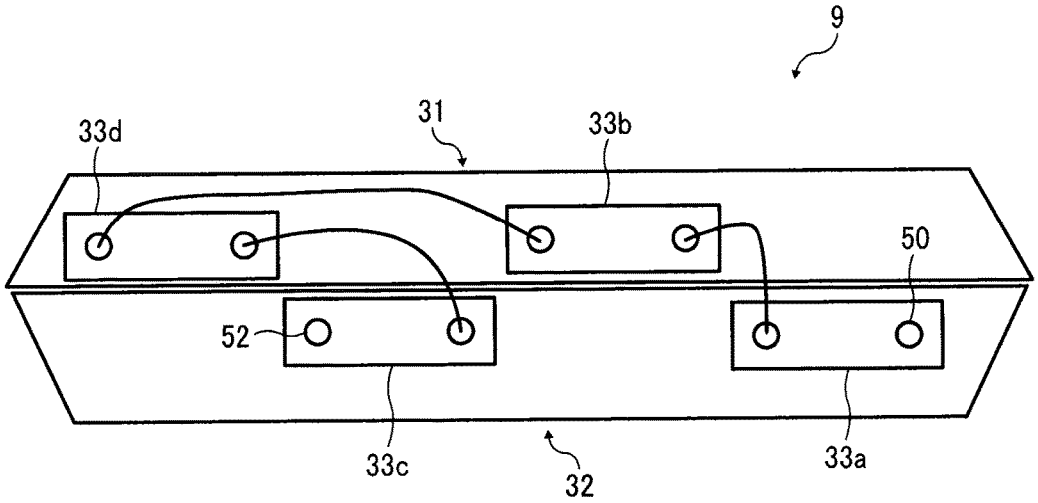
FIG. 20 is a schematic view of a cooling device according to another embodiment, seen from a rear side thereof.

FIG. 20 is a schematic view of a cooling device 9 according to another embodiment, seen from a rear side thereof.

In this example, each of a first conveyor 31 and a second conveyor 32 includes two coolers 33 serving as heat receivers. Cooling liquid is input to a first opening of a cooler 33*a* of the second conveyor 32 through a pipe 50, passes through coolers 33*b* and 33*d* of the first conveyor 31, and is output from a second opening of the cooler 33*c* of the second conveyor 32 through a pipe 52. As in the above-described embodiment, the pipes 50 and 52 include connecting portions, bending portions, and channel shift portions. The connecting portions extend rearward of the apparatus and is connected to a heat receiver 45 at the rear side of the second conveyor 32. The bending portions bend upward from the connecting portions. The channel shift portions extend upward from the bending portions to an upper structure. A leading end of each of the pipes 50 and 52 is fixed at a pipe fix portion of the upper structure. The first conveyor 31 is openable upward, and the second conveyor 32 is fixed. Accordingly, the pipes 50 and 52 used as input and output of cooling liquid are connected to the second conveyor 32 which is a fixed side. For such a configuration, when the first conveyor 31 is opened upward, the pipes 50 and 52 do not deform, thus reducing stress against the connecting portions 50*a* and 52*a* (FIG. 13) of the pipes 50 and 52.

As a result, such a configuration suppresses damage to or leakage of cooling liquid from the connecting portions 50*a* and 52*a* of the pipes 50 and 52. For example, for a cooling device according to another embodiment of this disclosure, a cooler(s) may be disposed in only a second conveyor 32 which is a fixed side while a first conveyor 31 rotatable has no cooler(s).

FIGS. 21 and 22A through 22C are schematic views of a variation of the cooling device.

In the above-described embodiment, the coolers 33 of the first conveyor 31 and the second conveyor 32 are serially connected to form the single circulation channel 47. However, in this example, coolers of a first conveyor 31 and a second conveyor 32 are not serially connected and form different circulation channels. Specifically, a pipe 370 is connected to a first opening and a second opening of a cooler 33*b* of the first conveyor 31 to form a single circulation channel. As in the above-described embodiment, pipes 50 and 52 are also connected to the second conveyor 32, and coolers 33*a* and 33*c* are serially connected to form a single circulation channel.

Figure 21:
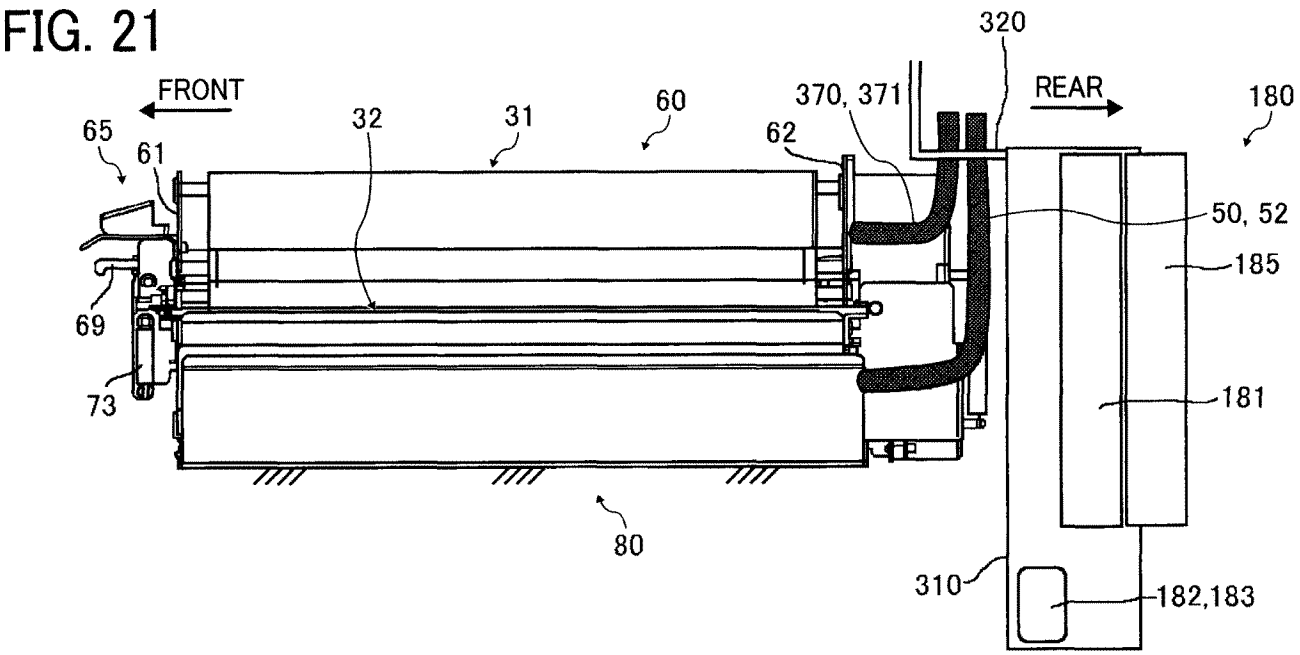
FIG. 21 is a schematic view of a variation of a cooling device.

Here, as illustrated in FIG. 21, the pipe 370 include connecting portions, bending portions, and channel shift portions. The connecting portions extend rearward of the apparatus and is connected to a heat receiver 45 at the rear side of the second conveyor 32. The bending portions bend upward from the connecting portions. The channel shift portions extend upward from the bending portions to an upper structure 320. Accordingly, four pipe fix portions are fixed on he upper structure 320 for the pipes 50, 52, 370, and 371. In this example, the pipe fix portions are arranged offset in an anteroposterior direction of the cooling device 9. However, instead of this arrangement, the pipe fix portions may be arranged offset in a recording-material conveyance direction. When two circulation channels are formed, two radiators, two pumps, and two liquid tanks are preferably arranged. However, in some embodiments, a common radiator may be used for two circulation channels.

In this example, the first conveyor 31 closer to the upper structure 320 is fixed, and the second conveyor 32 further away from the upper structure 320 is rotatable downward. A rotary shaft is a rear shaft 6 disposed at a rear side of the cooling device 9 as in the above-described embodiment.

Figure 22C:
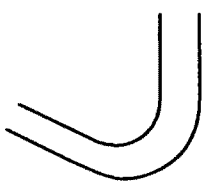
FIGS. 22A, 22B, and 22C are bent states of a pipe.
Figure 22B:
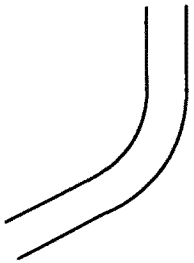
Figure 22A:
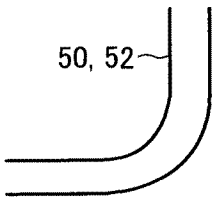

For such a configuration, the bending state of the pipes 50 and 52 displaces from a closed state of the second conveyor 32 illustrated in FIG. 22A to an open state of the second conveyor 32 illustrated in FIG. 22B.

By contrast, for a configuration in which the first conveyor 31 closer to the upper structure 320 is rotatable upward, and the second conveyor 32 further away from the upper structure 320 is fixed, the pipes 50 and 52 are more bent as illustrated in FIG. 22C. Accordingly, since a restoration force at which the pipes 50 and 52 try to return from the state of FIG. 22C to the state of FIG. 22A occurs, a greater force is needed to open the first conveyor 31. Further, a spring 70 is needed to have a greater force to hold the first conveyor 31 in the open state.

Hence, the first conveyor 31 connected to the pipes 370 and 371 is fixed so that the pipes 50 and 52 displace as illustrated in FIG. 22B, and the second conveyor 32 is configured to be rotatable downward. Such a configuration allows more stable opening and closing of the second conveyor, reduces stress against the pipes, and prevents damage to the pipes due to departure of the pipes or stress.

In some embodiments, the configuration in which the first conveyor 31 is fixed and the second conveyor 32 is rotatable downward is applied to the circulation channel of cooling liquid illustrated in FIG. 12. Such a configuration allows the pipes 50 and 52 to displace as illustrated in FIG. 22B when the second conveyor 32 is opened downward. In such a case, in FIG. 12, the second conveyor 32 can be rotated downward around the right-side rotary shaft (the rear shaft 63).

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A cooling conveyor, comprising:

a conveyor including at least a first conveyor supported by first rollers and a second conveyor supported by second rollers, the first conveyor and the second conveyor to sandwich and convey a recording material, the first conveyor to approach and separate from the second conveyor;

a cooler disposed in the second conveyor to cool the recording material after an image is fixed on the recording material;

a pipe connected to the cooler to flow a cooling liquid into the cooler, the pipe having a vertical portion which extends substantially vertically without a substantial horizontal displacement, and a horizontal portion connected to the cooler which extends substantially horizontally without a substantial vertical displacement, the vertical portion extending past a rear of the first conveyor without receiving or transmitting the cooling liquid from or to the first conveyor or any cooler which may contact the first conveyor; and a rotator to pivot the first conveyor to approach and separate from the second conveyor, the rotator further rotating the first rollers to approach and separate from the second rollers.

2. The cooling conveyor according to claim 1, wherein the rotator protrudes beyond the first conveyor toward the vertical portion, and the vertical portion is outside the first conveyor.

3. The cooling conveyor according to claim 1, further comprising a radiator to cool the cooling liquid after the cooling liquid passes through the cooler, the radiator to approach and separate from the conveyor, wherein the vertical portion is disposed away from a movement range of the radiator.

4. The cooling conveyor according to claim 1, further comprising a driving system including a driving motor to rotate a driving roller of the second conveyor, wherein the pipe is connected to the cooler, and the driving system is disposed adjacent to a connecting portion of the pipe connected to the cooler.

5. The cooling conveyor according to claim 1, further comprising:

a second cooler in the first second conveyor.

6. The cooling conveyor according to claim 1, wherein the first conveyor includes a cooler to cool the recording material after an image is fixed on the recording material.

7. An image forming apparatus, comprising:

the cooling conveyor according to claim 1; and an image forming device to form the image on the recording material.

8. The cooling conveyor according to claim 3, further comprising:

a radiator rotary shaft supporting the radiator rotatably relative to an image forming apparatus; and a duct disposed in an interior space defined by a rear face of the image forming apparatus and a side wall of the radiator closed with the radiator rotary shaft.

9. The cooling conveyor according to claim 1, further comprising:

a pipe fix portion on which the pipe is fixed; and an upper structure fixed on an image forming apparatus, wherein the pipe fix portion is fixed on the upper structure.

10. The cooling conveyor according to claim 9, wherein the pipe has a connector extended from the cooler and removably connected to the pipe fix portion.

11. A cooling conveyor, comprising:

a conveyor including at least a first conveyor supported by first rollers and a second conveyor supported by second rollers, the first conveyor and the second conveyor to sandwich and convey a recording material, the first conveyor to approach and separate from the second conveyor;

a cooler disposed in the second conveyor to cool the recording material after an image is fixed on the recording material;

a pipe connected to the cooler to flow a cooling liquid into the cooler, the pipe having a vertical portion which extends substantially vertically without a substantial horizontal displacement, and a horizontal portion connected to the cooler which extends substantially horizontally without a substantial vertical displacement, the vertical portion extending vertically through a plane of the first conveyor; and a rotator to pivot the first conveyor to approach and separate from the second conveyor, the rotator further rotating the first rollers to approach and separate from the second rollers.

12. The cooling conveyor according to claim 11, wherein the rotator protrudes beyond the first conveyor toward the vertical portion, and the vertical portion is outside the first conveyor.

13. The cooling conveyor according to claim 11, further comprising a radiator to cool the cooling liquid after the cooling liquid passes through the cooler, the radiator to approach and separate from the conveyor, wherein the vertical portion is disposed away from a movement range of the radiator.

14. The cooling conveyor according to claim 11, further comprising a driving system including a driving motor to rotate a driving roller of the second conveyor, wherein the pipe is connected to the cooler, and the driving system is disposed adjacent to a connecting portion of the pipe connected to the cooler.

15. The cooling conveyor according to claim 11, further comprising:

a second cooler in the second conveyor.

16. The cooling conveyor according to claim 11, wherein the first conveyor includes a cooler to cool the recording material after an image is fixed on the recording material.

17. An image forming apparatus, comprising:

the cooling conveyor according to claim 11; and an image forming device to form the image on the recording material.

* * * * *